US006341905B1

(12) United States Patent
Suzuki

(10) Patent No.: US 6,341,905 B1
(45) Date of Patent: Jan. 29, 2002

(54) RECORDING APPARATUS

(75) Inventor: Tetsuo Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/542,461

(22) Filed: Apr. 4, 2000

(30) Foreign Application Priority Data

Apr. 6, 1999 (JP) ..... 11-098769
Mar. 27, 2000 (JP) ..... 2000-086402

(51) Int. Cl.[7] ..... B41J 2/315
(52) U.S. Cl. ..... 400/120.09; 347/16; 347/104
(58) Field of Search ..... 400/120.09, 56, 400/636; 347/104, 3, 16, 43, 248

(56) References Cited

U.S. PATENT DOCUMENTS

| | | | | |
|---|---|---|---|---|
| 4,814,792 A | * | 3/1989 | Yamanobe et al. | 347/248 |
| 5,133,611 A | * | 7/1992 | Nakajima | 400/56 |
| 5,348,283 A | | 9/1994 | Yanagi et al. | 371/127 |
| 5,370,380 A | | 12/1994 | Suzuki et al. | 271/21 |
| 5,469,197 A | * | 11/1995 | Hiramatsu | 347/16 |
| 5,477,246 A | * | 12/1995 | Hirabayashi et al. | 347/16 |
| 5,508,796 A | | 4/1996 | Sasame et al. | 355/271 |
| 5,539,507 A | | 7/1996 | Miyashiro et al. | 355/271 |
| 5,543,904 A | | 8/1996 | Kato et al. | 355/285 |
| 5,580,042 A | | 12/1996 | Taniguro et al. | 271/274 |
| 5,592,280 A | | 1/1997 | Ishizuka et al. | 399/410 |
| 5,620,174 A | | 4/1997 | Taniguro et al. | 271/10.12 |
| 5,648,808 A | | 7/1997 | Yanagi et al. | 347/104 |
| 5,672,019 A | | 9/1997 | Hiramatsu et al. | 400/624 |
| 5,725,319 A | | 3/1998 | Saito et al. | 400/629 |
| 5,761,571 A | | 6/1998 | Suzuki et al. | 399/66 |
| 5,999,760 A | | 12/1999 | Suzuki et al. | 399/45 |
| 6,065,830 A | * | 5/2000 | Hiramatsu et al. | 347/104 |
| 6,169,557 B1 | * | 1/2001 | Suzuki et al. | 347/104 |

FOREIGN PATENT DOCUMENTS

| | | |
|---|---|---|
| EP | 0 658 433 | 6/1995 |
| JP | 7-165338 | 6/1995 |

* cited by examiner

*Primary Examiner*—Eugene Eickholt
(74) *Attorney, Agent, or Firm*—Fitzpatrick, Cella, Harper & Scinto

(57) ABSTRACT

A recording apparatus has an automatic feed device for feeding recording media one by one, and a pair of carriage rollers for carrying a recording medium P thus fed, to a recording section. The recording apparatus is constructed to be used in a plurality of recording modes. In the recording apparatus, a registration method of the recording medium P to the recording section is selected depending upon a recording mode selected. The apparatus of this structure solved the prior-art problems that a long time was necessary from sheet feed to recording start in the case of registration of the recording medium P by the nip between the carriage roller pair, so as to be a bottleneck in increase of recording speed and that disturbance of the image became prominent due to registration deviation in the case of registration at the side of the recording medium.

21 Claims, 16 Drawing Sheets

RECORDING APPARATUS

BACKGROUND OF THE INVENTION

1. Field of the Invention

The present invention relates to a recording apparatus having a recording head for forming an image on a recording medium and, more particularly, to a recording apparatus having an automatic paper feed device.

2. Related Background Art

The recording apparatus having the function of a printer, a copier, a facsimile machine, or the like, or the recording apparatus used as an output device for workstations and complex electronic devices including computers, word processors, etc., is constructed to record an image on a recording medium such as a paper sheet or a thin plastic sheet or the like, based on image information. These recording apparatuses can be classified by their recording methods; i.e., under the ink jet type, the wire dot type, the thermal type, the laser beam type, and so on.

In the recording apparatus of a serial type to perform a serial scan in a direction (main scanning direction) perpendicular to a carriage direction (sub-scanning direction) of the recording medium, an image is recorded (in a main scan) by a recording means mounted on a carriage moving along the recording medium, the recording medium is fed by a predetermined amount (pitch feed (conveying)) after completion of recording of one line, and the recording medium is stopped again thereafter to undergo recording of a next-line image (main scan). This operation is carried out repeatedly to perform recording on the entire area of the recording medium.

In the recording medium of a line type to perform recording by only sub-scanning in the carriage direction of the recording medium, the recording medium is set at a predetermined recording position, recording of one line is carried out in one step, the recording medium is then fed by a predetermined amount (pitch feed), and recording of a next line is further carried out in one step. This operation is carried out repeatedly to perform recording on the entire area of the recording medium.

Among the above-stated recording apparatus, the recording apparatus of the ink jet type (ink jet recording apparatus) is constructed to record the image by ejecting ink from the recording means (recording head) onto the recording medium and has such advantages that reduction in size of the recording means is easy, that a high-definition image can be recorded at high speed, that it can record an image on plain paper without necessity for an extra treatment, that the running cost is low, and that it makes little noise because of a non-impact method. In addition, it also has another advantage in that a color image can be recorded readily by use of ink liquids of multiple colors. Among others, the line-type apparatus using the recording means of the line type with a lot of ink ejection ports arrayed along the direction of the sheet width has the potential for further increase in the speed of recording.

Particularly, the recording means (recording head) of the ink jet type to eject the ink by making use of thermal energy can be produced readily in high-density liquid path layout (ejection port layout) by forming electrothermal transducers, electrodes, liquid path walls, top plates, etc. in films on a substrate through semiconductor fabrication processes such as etching, evaporation, sputter, and so on, and thus its structure can be reduced in size even further.

Use of advantages of the IC technology and microprocessor technology facilitates an increase in the length and formation in a surface (two-dimensional area) of the recording means and also facilitates full multi-color formation and high-density dot formation of the recording means.

In recent years, these recording devices are being equipped with an automatic paper feed device for storing a stack of recording media thereon and for feeding them one by one to a recording section while separating one from the others. Therefore, there is no need for setting each of recording media one by one for recording and this allows a large volume of recording to be carried out at once. For registration with the recording head in a printing area, a recording medium fed from the automatic paper feed device is positioned by a method of positioning the leading edge of the recording medium by a nip between a pair of carriage rollers located on the upstream side of the recording head or by a method of positioning the side of the recording medium by aligning it with a recording-medium reference surface on the upstream side of the recording head.

However, when the registration of the recording medium is made by the nip between the carriage roller pair, the carriage roller pair has to be kept stationary or be rotated backward in order to make the leading edge of the recording medium butt against the nip. This inevitably requires a longer time from the start of sheet feed to the start of recording and it is a bottleneck to increase in the recording speed in recent years, particularly, in the ink jet recording apparatus.

On the other hand, the registration at the side of the recording medium is free of such time loss for registration, but is apt to be affected by cutting accuracy of the recording medium and a guide member for guiding the side of the recording medium. This raised the issue that disturbance of the image became prominent due to registration deviation in the case of a high-quality mode in which recording was carried out in a longer time than in the case of a normal mode. Further, the case of small recording media in the size of postcards or the like, good registration was not made using only the guide member at the side and the above issue became more prominent in the case of the high-quality mode for photo-like images.

SUMMARY OF THE INVENTION

The present invention has been accomplished in order to solve the above problems and an object of the present invention is to provide a recording apparatus that permits remarkable increase of the throughput in recording of documents and that also permits good recording without disturbance of the image in the high-quality recording of photo-like images etc. other than the documents.

The present invention presents the recording apparatus characterized by having the following structure.

(1) A recording apparatus having a plurality of recording modes, said recording apparatus comprising an automatic sheet feed device for feeding recording media one by one and a pair of convey (carriage) rollers for conveying (carrying) a recording medium thus fed, to a recording section, wherein a registration method of the recording medium to the recording section is selected according to said recording mode.

(2) The recording apparatus as set forth in (1), wherein when the recording mode is a high-quality mode, registration to align a leading edge of the recording medium with a nip between the carriage roller pair is selected, but said registration is not selected in a high-speed mode or in a normal mode.

(3) A recording apparatus having a plurality of recording modes, the recording apparatus comprising an automatic feed device for feeding recording media one by one and a pair of carriage rollers for carrying a recording medium thus fed, to a recording section, wherein a registration method of the recording medium to the recording section is selected according to the recording mode and a kind of said recording medium.

(4) The recording apparatus as set forth in (3), wherein when the recording medium is a special medium, registration to align a leading edge of the recording medium with a nip between the carriage roller pair is selected, but said registration is not selected when the recording medium is plain paper.

(5) The recording apparatus as set forth in (4), wherein said special medium is a recording medium other than the plain paper; e.g., coat paper or the like including a postcard.

(6) A recording apparatus capable of using a plurality of recording heads by replacing one with another, the recording apparatus comprising an automatic feed device for feeding recording media one by one and a pair of carriage rollers for carrying a recording medium thus fed, to a recording section, wherein a registration method of the recording medium to the recording section is selected according to the recording head.

(7) The recording apparatus as set forth in (6), wherein when the recording head is a color head for photo-like images, registration to align a leading edge of the recording medium with a nip between the carriage roller pair is selected, but said registration is not selected during use of a monochromatic head or a normal color head.

DETAILED DESCRIPTION OF THE PREFERRED EMBODIMENTS

An embodiment of the present invention will be described hereinafter with reference to the accompanying drawings.

Figure 1:
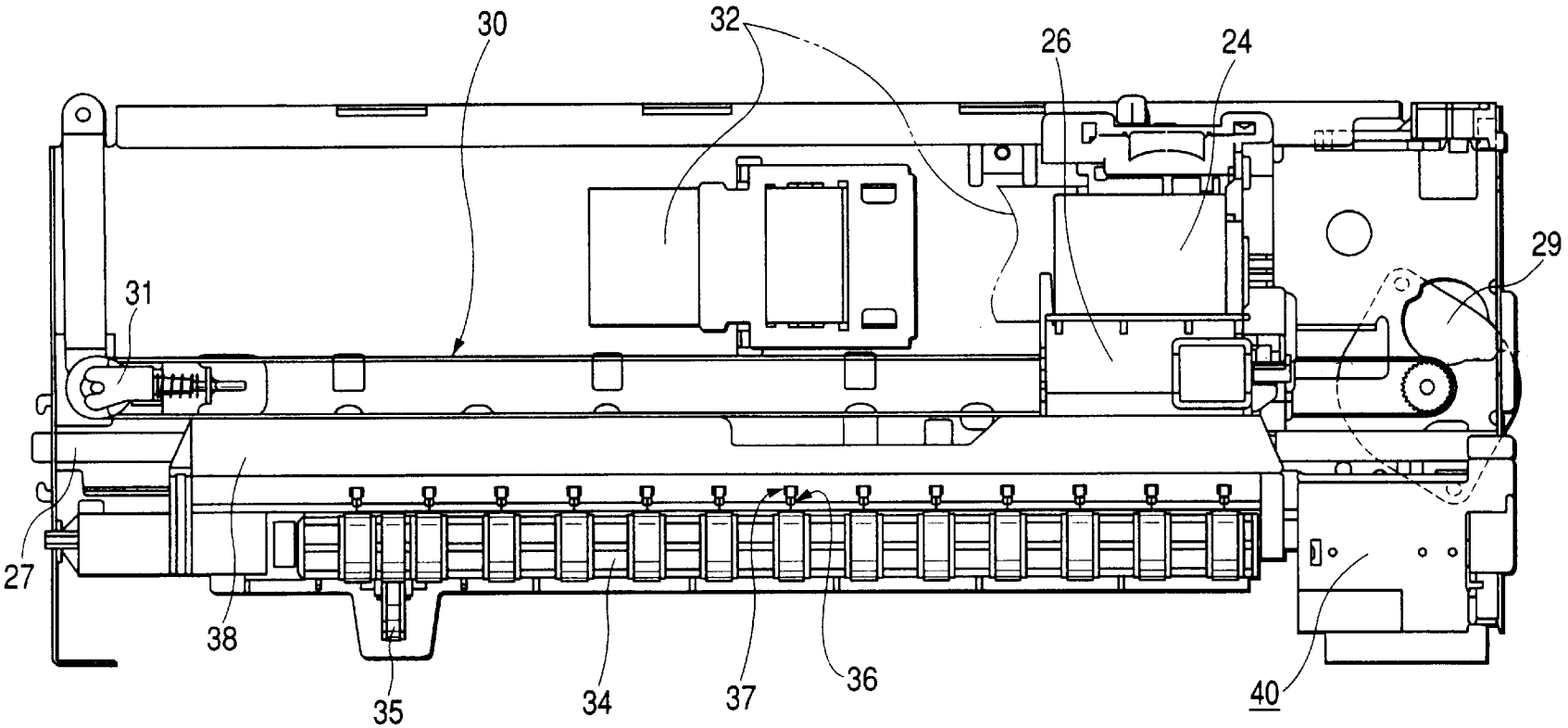
FIG. 1 is a front view of the recording apparatus according to Embodiment 1 of the present invention.
Figure 2:
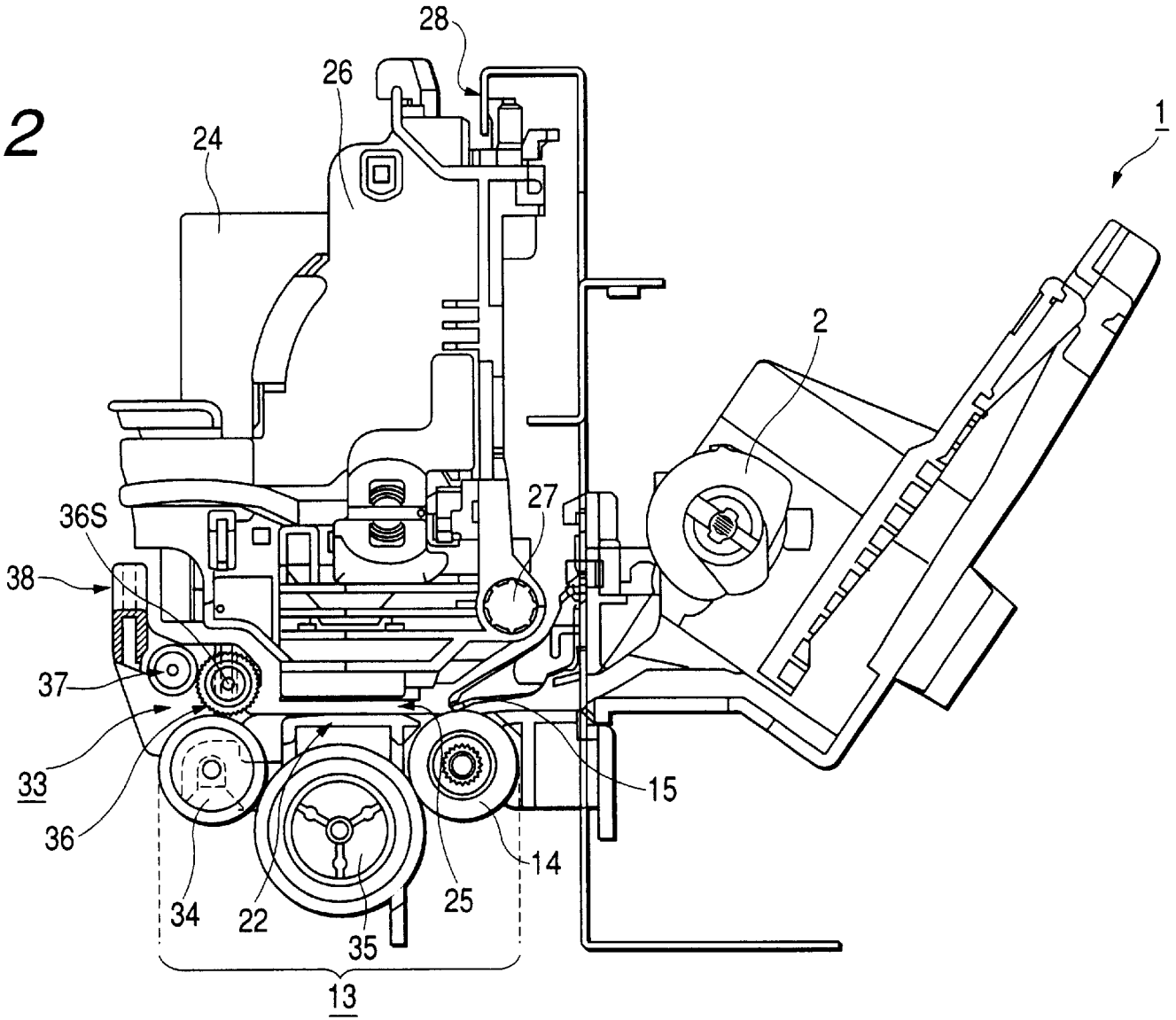
FIG. 2 is a side view of the recording apparatus from which a side plate is removed.
Figure 3:
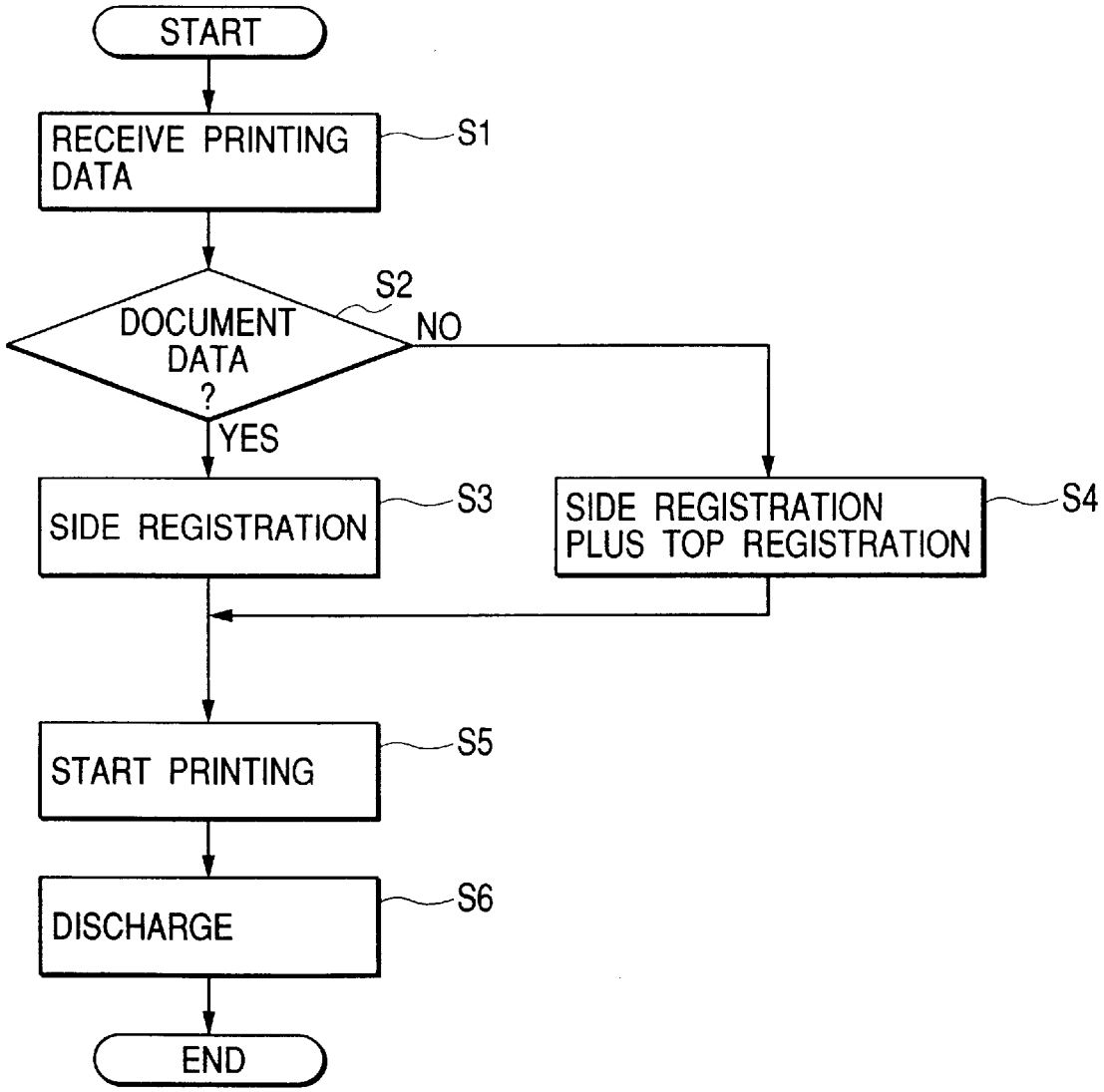
FIG. 3 is a flowchart to explain operation of Embodiment 1 of the present invention.
Figure 4:
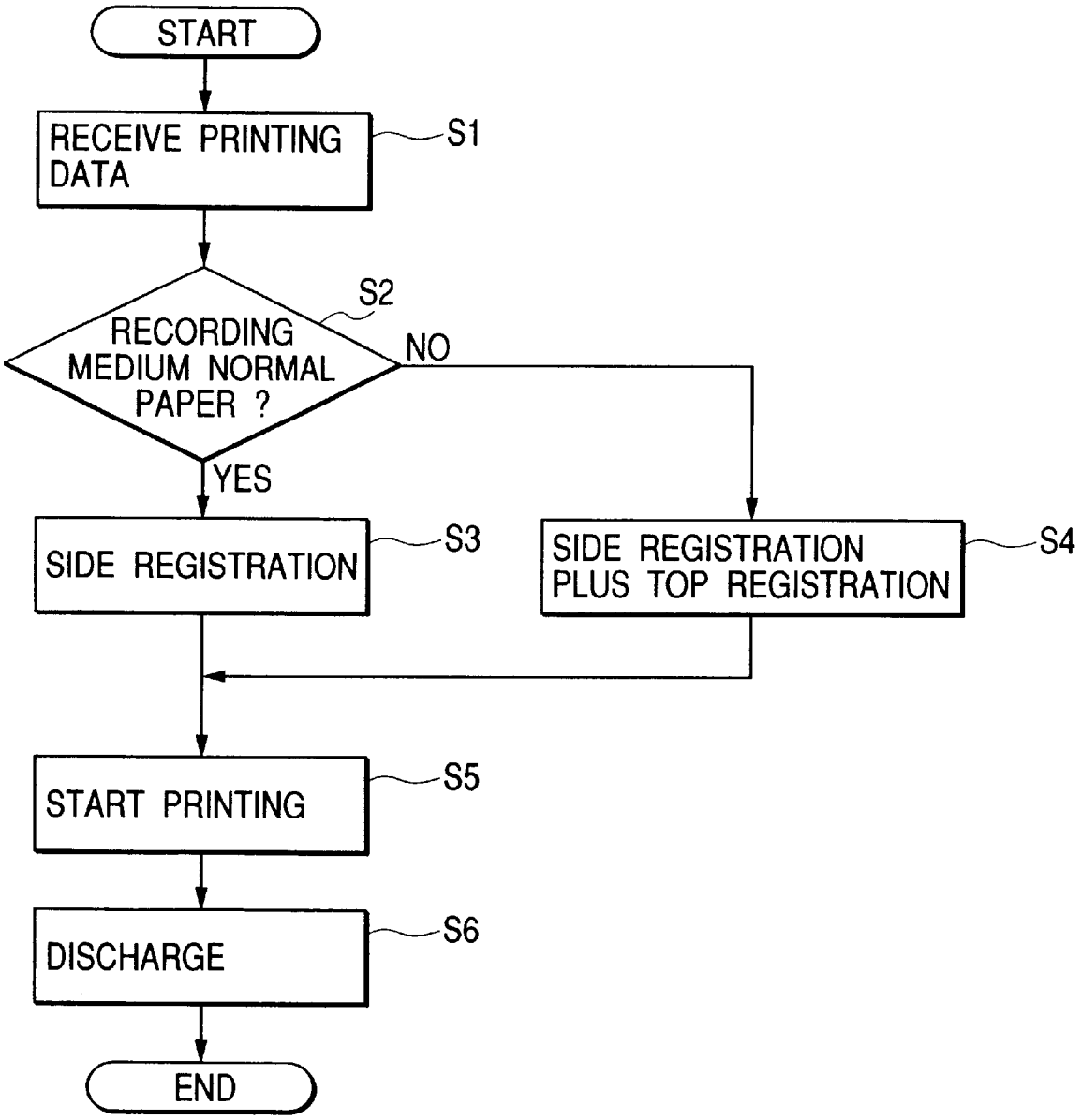
FIG. 4 is a flowchart to explain operation of Embodiment 2 of the present invention.
Figure 5:
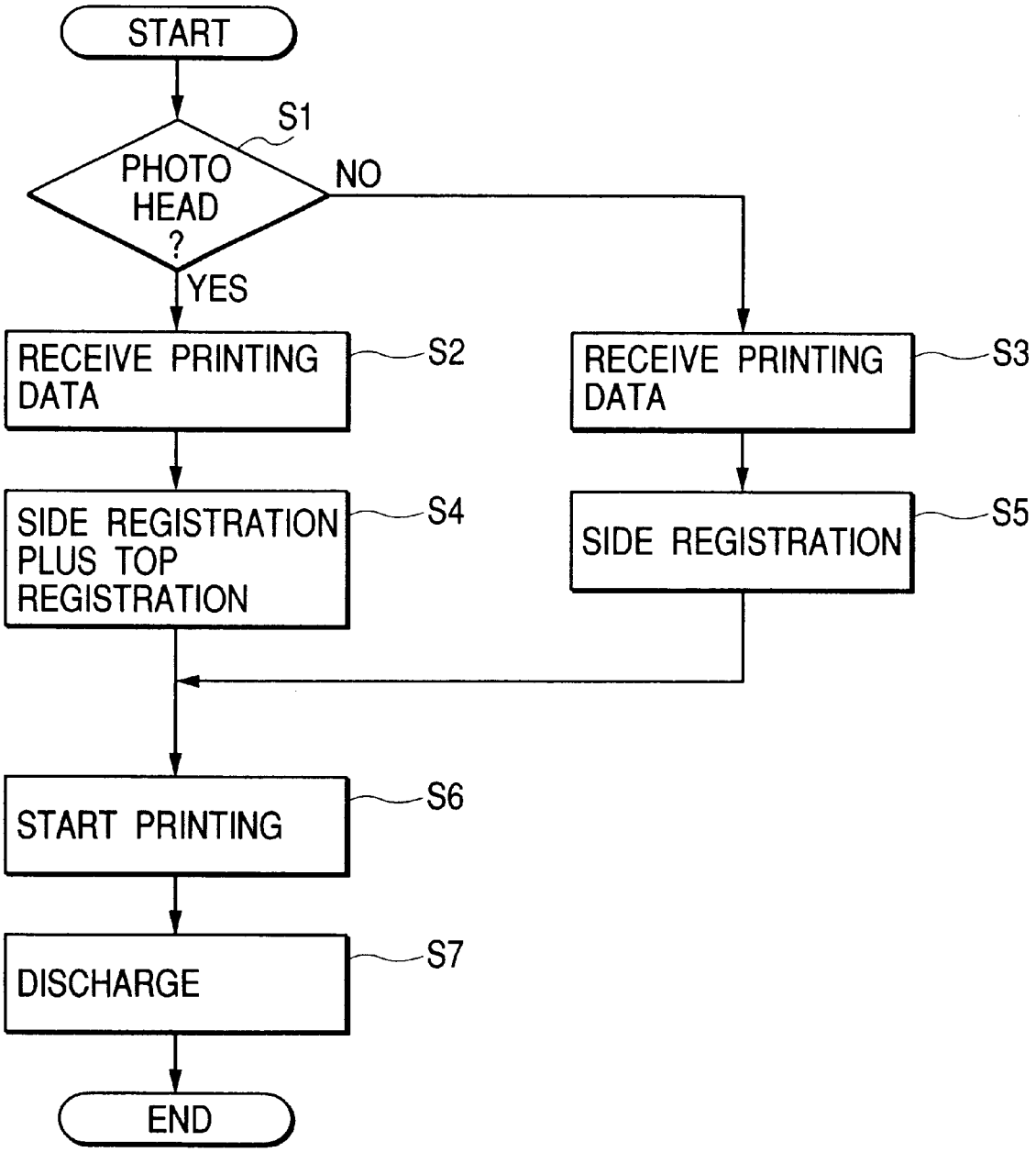
FIG. 5 is a flowchart to explain operation of Embodiment 3 of the present invention.

FIG. 1 is an explanatory front view to show the schematic structure of an ink jet recording apparatus as Embodiment 1 of the present invention, FIG. 2 is an explanatory cross-sectional view of the ink jet recording apparatus, and FIG. 3 to FIG. 5 are flowcharts for explaining the operation of the ink jet recording apparatus.

The ink jet recording apparatus according to Embodiment 1 is a recording device incorporating a feed device of recording medium (hereinafter referred to as sheet P), and is provided with a sheet feed device (automatic paper feed device) 1, a sheet feeding section 13, a sheet discharge section 33, a recording section 25, a cleaning section 40, and so on. The structure of these sections will be described below.

First, the structure of the sheet feed device 1 will be described. This sheet feed device 1 is mounted on the apparatus body at the angle of 30° to 60° as illustrated in FIG. 2 and is constructed to discharge a set sheet P approximately in the horizontal direction for recording.

A recording head 24 is one for recording a character image of ink on the sheet (recording medium) P conveyed by carriage roller 14 and pinch roller 15 as a carriage roller pair, and the recording method employed in this apparatus is the ink jet recording method to record the image by ejection of ink from the recording head 24. Specifically, this recording head 24 is equipped with fine liquid ejection ports (orifices), liquid paths, energy acting portions provided in part of the liquid paths, and energy generating means for generating droplet-forming energy applied to the liquid present in the energy-acting portions.

The recording section 25 has a carriage 26, on which the recording head 24 is mounted as illustrated in FIGS. 1 and 2, a guide shaft 27 for moving this carriage 26 back and forth in the direction perpendicular to the sheet carriage direction, a guide 28 holding the back end of the carriage 26 to maintain the distance between the recording head 24 and the sheet P, a timing belt 30 for transmitting driving force from a carriage motor 29 to the carriage 26, an idle pulley 31 for stretching this timing belt 30, a flexible board 32 for transmitting a head driving signal from an electric board to the recording head 24, and so on.

The recording head 24 is a replaceable recording head integrally constructed with an ink tank, and records a character image of ink on the sheet P carried on a platen 22 as it moves together with the carriage 26.

As types of recording heads, there is a monochromatic high-speed recording head used mainly for documents, a color recording head used for recording of color documents, graphics, etc., a photo recording head dedicated for high-quality photo-like images, and an ID is assigned to each recording head, whereby the apparatus can identify which type of head is set when mounted on the carriage.

The cleaning section 40 is constructed, as illustrated in FIG. 1, of an unillustrated pump for cleaning of the recording head 24, an unillustrated cap for preventing drying of the recording head 24, an unillustrated driving switch arm for switching driving from the carriage roller 14 between the sheet feed device 1 and the pump, and so on.

The sheet discharge section 33 is provided with a sheet discharge roller 34, a transmission roller 35 for transmitting driving of the carriage roller 14 to the sheet discharge roller, spurs 36 for assisting discharge of the sheet P, and spur cleaners 37 for absorbing the ink attached to spurs 36, as illustrated in FIGS. 1 and 2, and is constructed to discharge the sheet by the sheet discharge roller 34 and spurs 36 without spoiling the recording surface of the sheet after the recording.

In this Embodiment 1, the spurs 36 are attached to a spur stay 38 being a spur mount portion, so as to rotate about an elastic axis 36*s*, whereby an urging force against the sheet P is generated by the elastic axis 36*s*.

In the sheet discharge section 33, the sheet discharge roller 34 is constructed of a single shaft and a driving force thereof is obtained from the carriage roller 14 of the sheet feeding section 13 through the transmission roller 35. The transmission roller 35 is urged against a drive-transmitted portion of the sheet discharge roller 34 by an elastic shaft not illustrated.

For registration at the side of the sheet P by the sheet feed device 1 in the above structure, a rotational force is produced by a difference between lengths of clearance zones formed in two sheet feed rollers 2 provided on the same axis in the widthwise direction of the sheet P, so as to push the sheet P against a sheet reference surface (a side registration method), as described in Japanese Patent Application Laid-Open No. 07-165338. Therefore, the sequential operation is arranged to end the process from the sheet feed to orientation of the sheet P at the top margin for printing, which increases the throughput.

Figure 6:
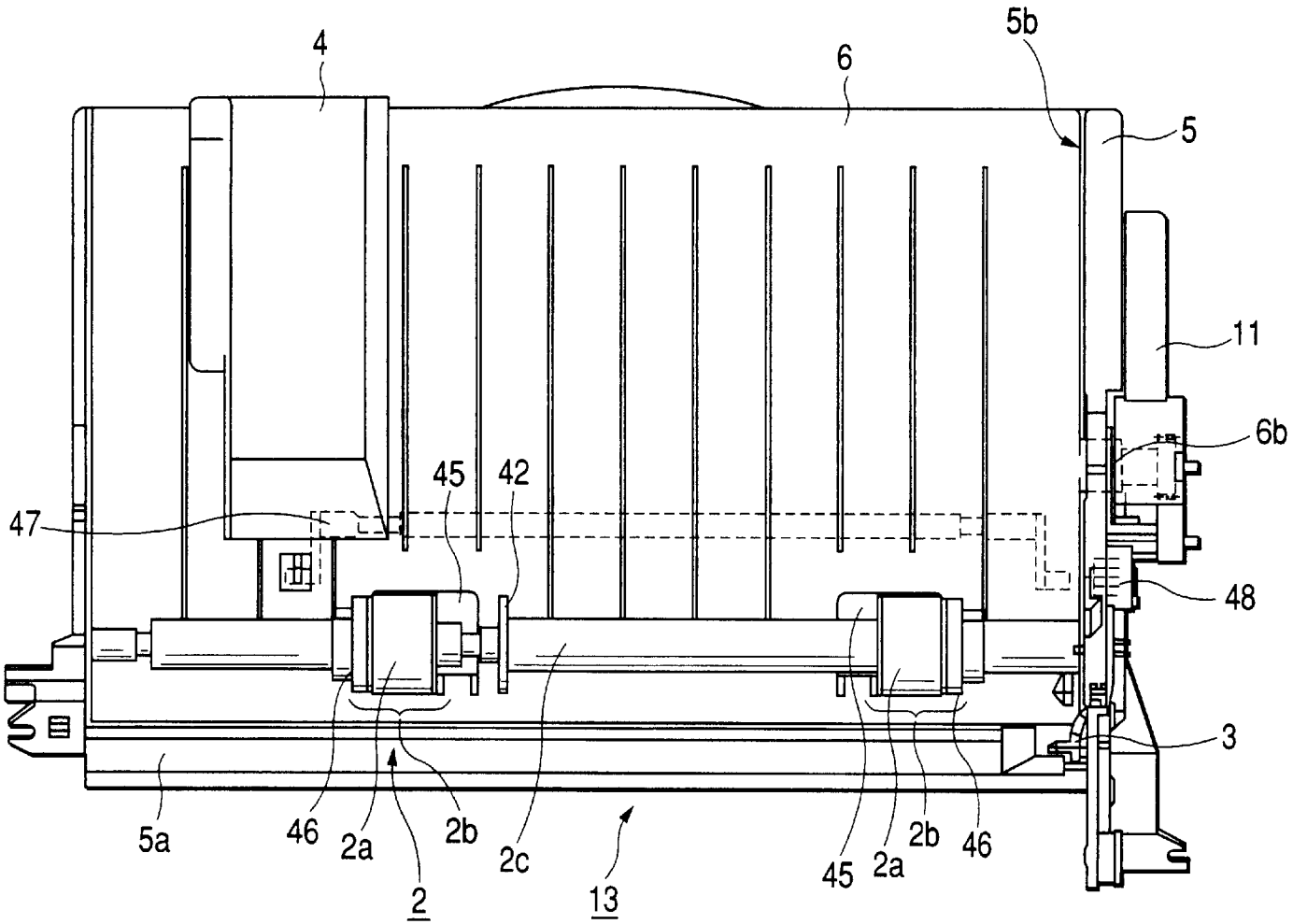
FIG. 6 is a front view of a sheet feed device.
Figure 7:
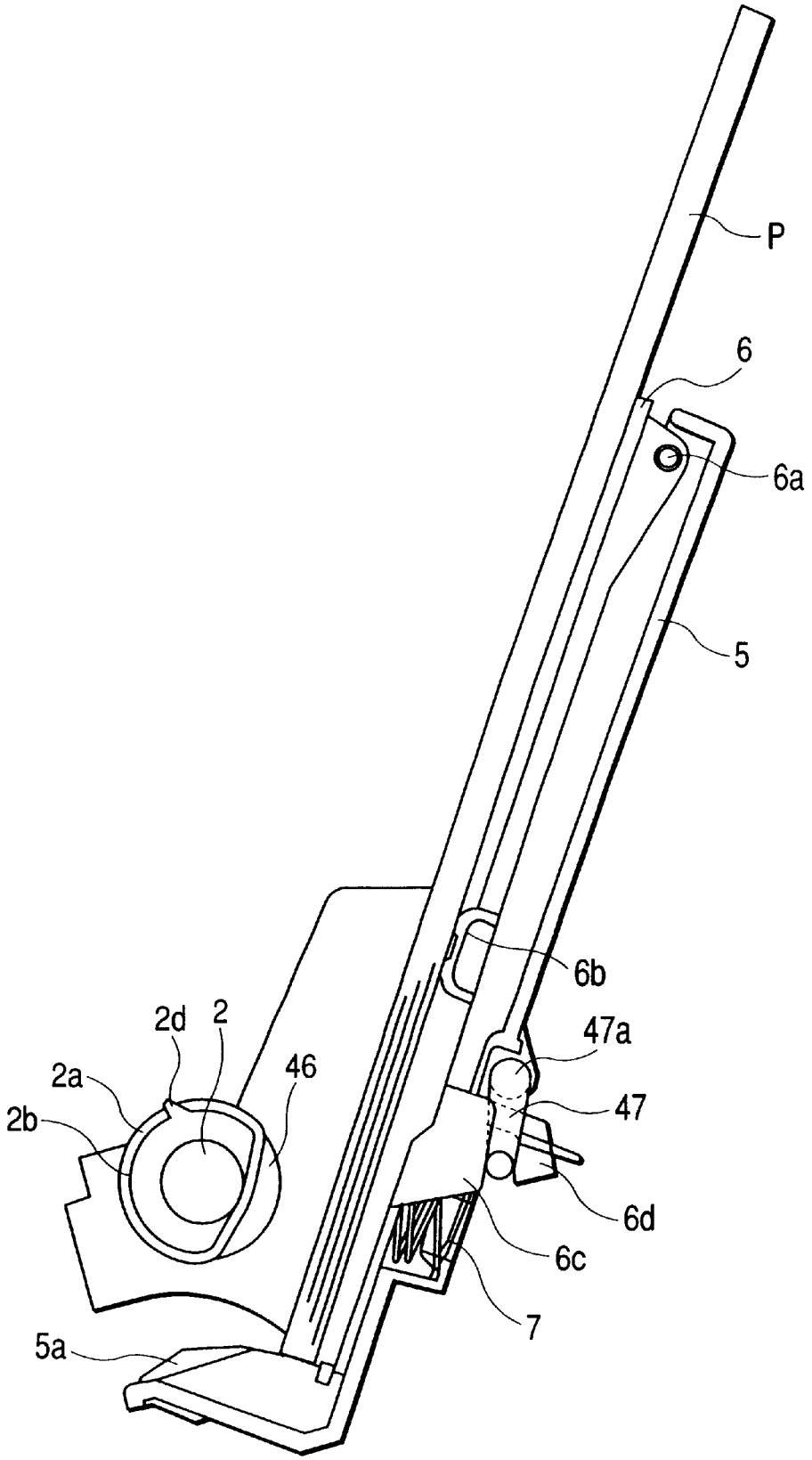
FIG. 7 is a side view of the sheet feed device.

The structure of the sheet feed section 1 for effecting the side registration will be described below in detail. The sheet feed section 1 constitutes a unit in which its components are mounted on a base 5, as illustrated in FIG. 6. The sheet feed section 1 of the present embodiment uses one side of the recording sheet P as a reference and a right side plate 5*b* of the base 5 is a reference member forming a sheet reference surface. The base 5 is formed so as to allow a press plate 6 to be moved back and has recess portions for provision of press-plate springs 7 at positions approximately opposite to roller portions 2*b* of sheet feed rollers 2, as illustrated in FIG. 7. The press plate 6 is coupled to the base 5 by a press-plate shaft 6*a* formed at the upper part of its both side surfaces, as illustrated in FIG. 7, and is thus mounted so as to be rotatable about the press-plate shaft 6*a*. As illustrated in FIG. 6, separation pads 46 made of a material with a relatively large coefficient of friction, such as artificial leather or the like, are provided at positions opposite to the sheet feed rollers 2 on the above press plate 6 to prevent multiple-sheet feed or the like from occurring when the number of loaded recording sheets P becomes small. A movable side guide 4 capable of being slid left and right is mounted on the press plate 6, so as to allow recording sheets P of different sizes to be set relative to the reference member surface as a sheet reference surface.

Figure 8:
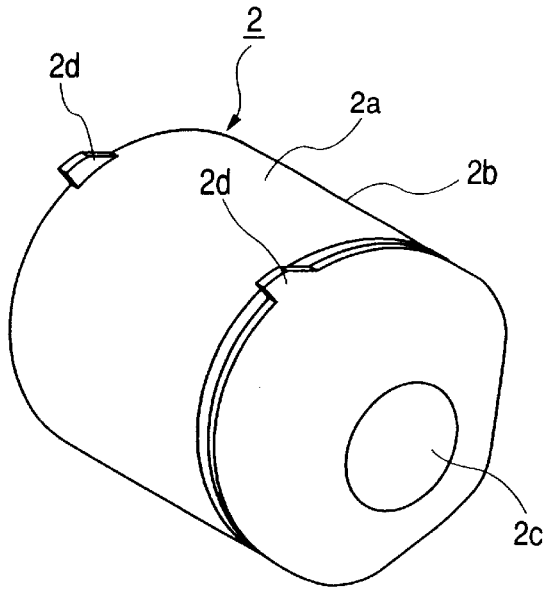
FIG. 8 is an explanatory diagram of a sheet feed roller.

Each of the sheet feed rollers 2 is held at its both ends by the base 5 so as to be rotatable. This sheet feed roller 2 is an integrally molded product of a plastic material or the like consisting of a roller portion 2*b* and a shaft portion 2*c*, as illustrated in FIG. 8, and a feed-roller rubber member 2*a* for carriage of the recording sheet P is placed around the roller portion 2*b*. The roller portion 2*b* has a D-cross-sectional shape (or a semicircular shape) and the roller pad 46 having the radius 0.5 to 3 mm smaller than the radius of the feed-roller rubber member 2*a* around the sheet feed roller 2 is disposed at each outer side of the roller portion 2*b*. They prevent the recording sheet P from touching the feed-roller rubber members 2*a* of the sheet feed rollers 2 during periods except for the sheet feed periods, thereby preventing soiling of the image or positional deviation of the sheet feed rollers 2.

Figure 9A:
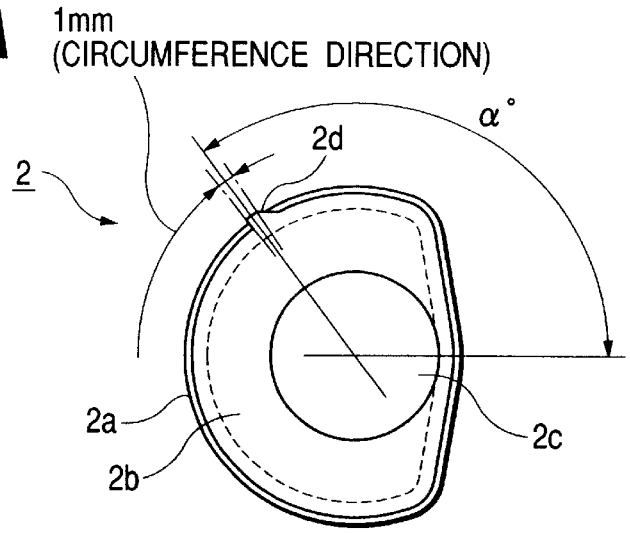
FIG. 9A and FIG. 9B are explanatory diagrams of the sheet feed roller.
Figure 9B:
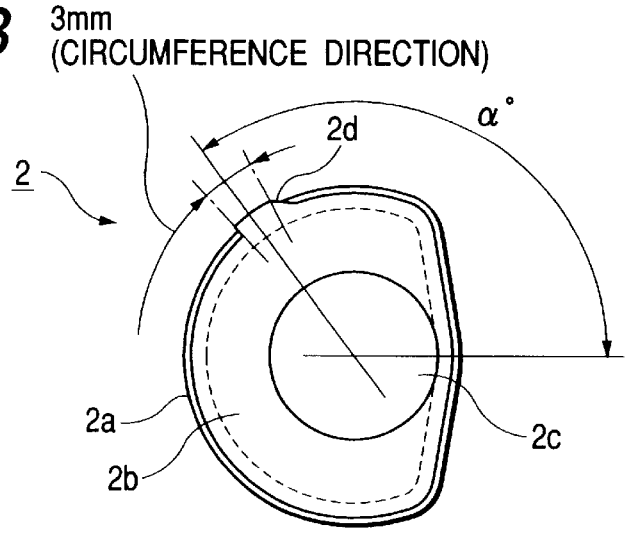

As illustrated in FIG. 6, the two roller portions 2*b* of the above structure are attached to the shaft portion 2*c* and fixed at their respective positions of about 40 mm and about 170 mm from the reference member. Therefore, A4-size sheets etc. are conveyed by the two roller portions 2*b*, whereas postcards etc. are conveyed by only one roller portion 2*b* on the reference member side. Areas of upright ribs 2*d* set in the radius greater than the above feed-roller rubber members 2*a* (the areas will hereinafter be referred to as "clearance zones") are provided on both sides of each roller portion 2*b*. The clearance zones have the circumferential distance of 1 mm in the roller portion 2*b* of the sheet feed roller 2 on the reference member side as illustrated in FIG. 9A, while the clearance zones have the circumferential distance of 3 mm in the roller portion 2*b* of the other sheet feed roller 2 as illustrated in FIG. 9B. The clearance zones have the same radius, and angles ($\alpha°$) at the center position of each area are matched with each other between the sheet feed rollers 2.

Figure 10:
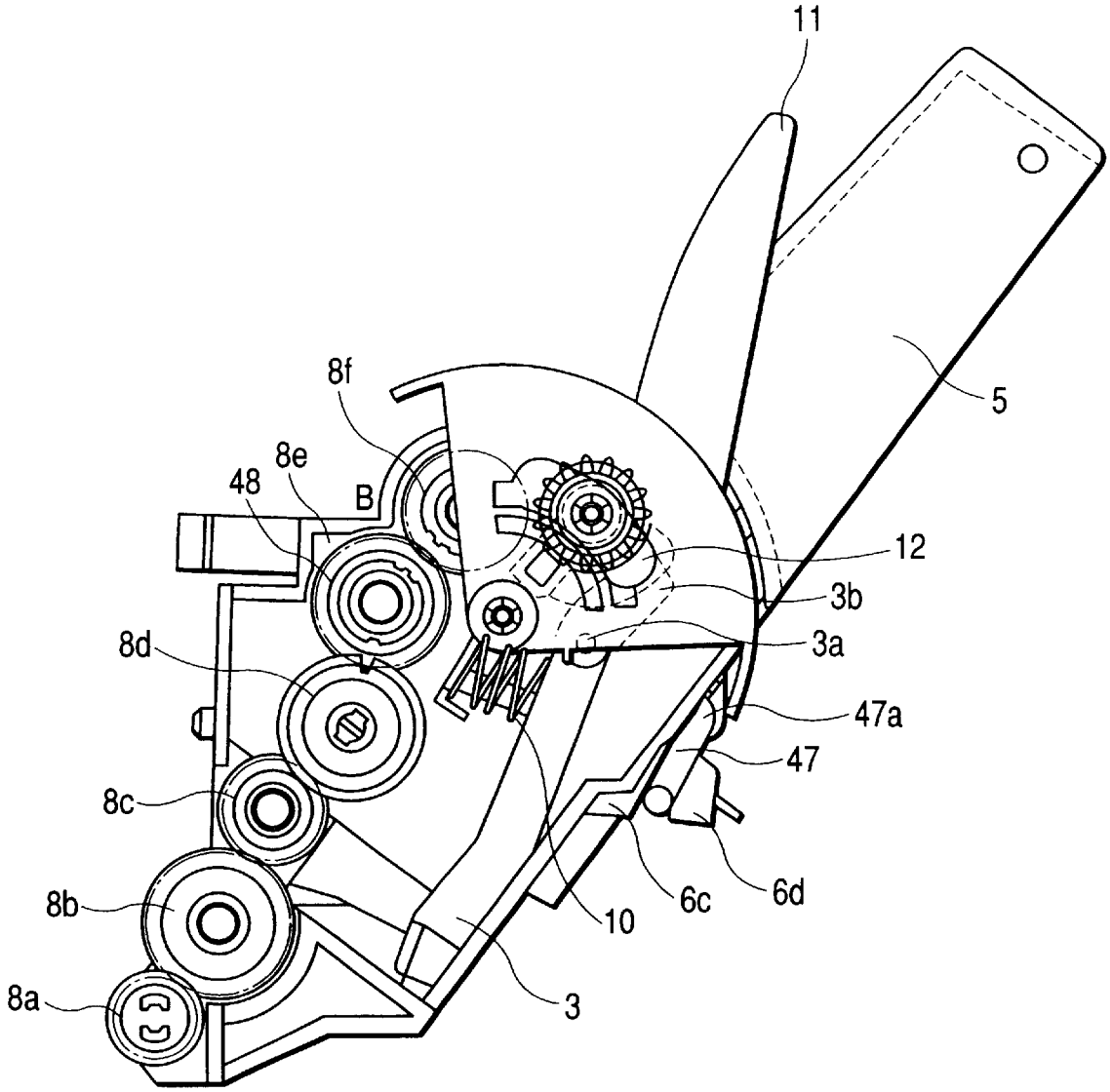
FIG. 10 is a side view to show a drive transmission system of the sheet feed device.
Figure 11:
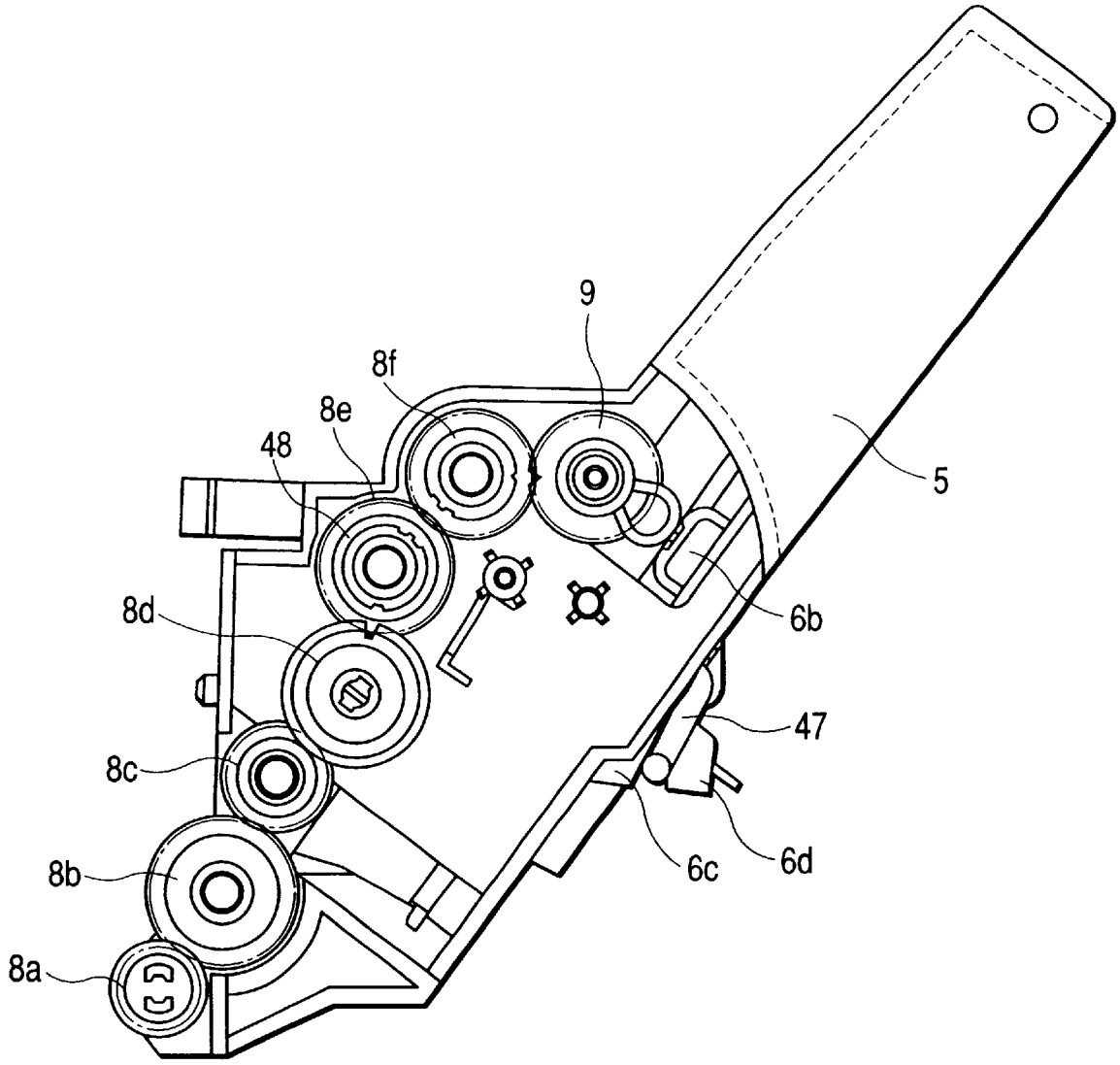
FIG. 11 is a side view to show the drive transmission system of the sheet feed device.
Figure 12:
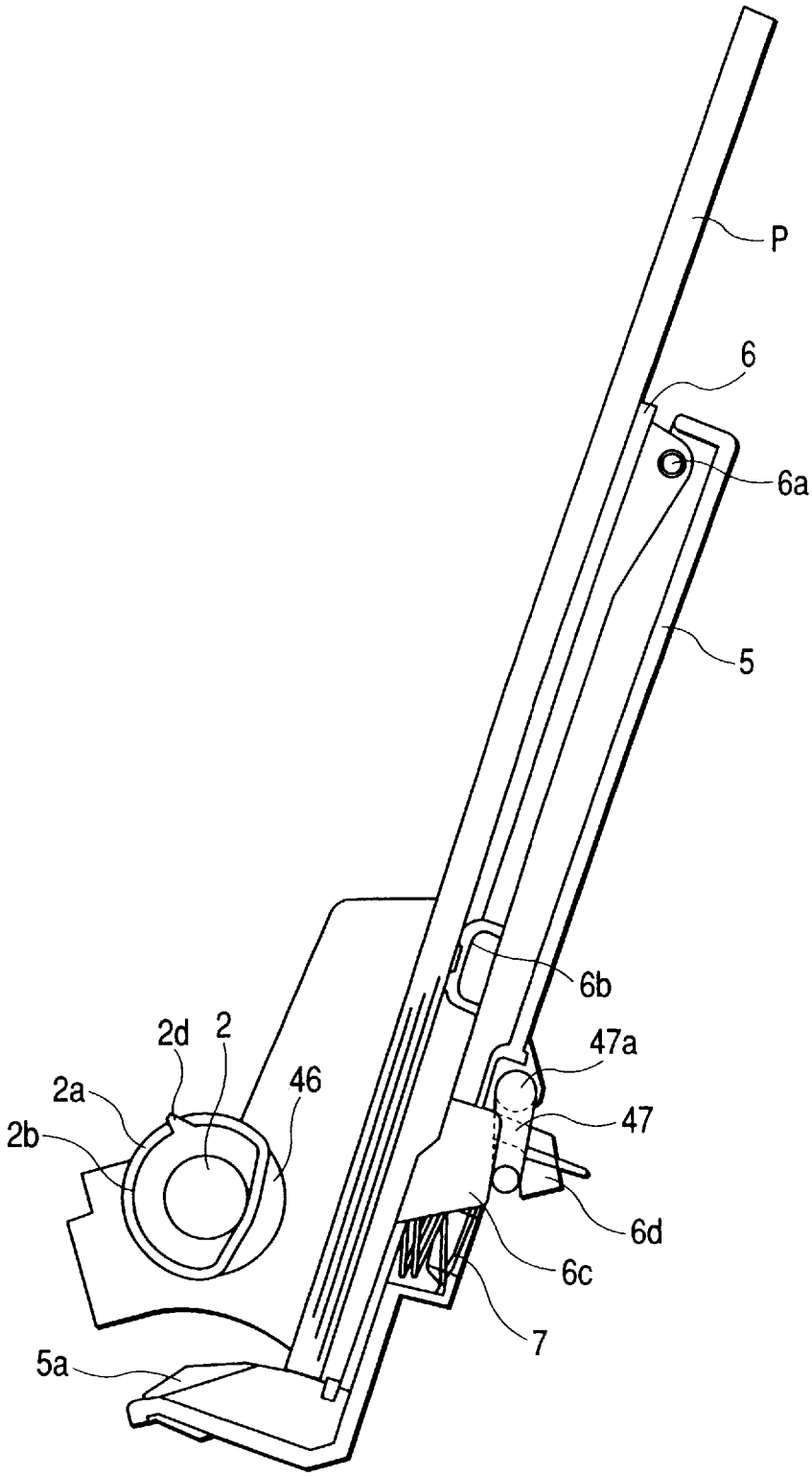
FIG. 12 is a side view of the sheet feed device.

As illustrated in FIG. 10 and FIG. 11, an input gear 8*a* transmits the driving force through idler gears 8*b*, 8*c* to a feed-roller gear 8*d* coupled to the sheet feed rollers 2, to rotate the sheet feed rollers 2 so as to convey the recording sheet P. Further, the feed-roller gear 8*d* transmits the driving force through a clutch gear 8*e* and an idler gear 8*f* to a release cam 9. At this time, the sheet feed rollers 2 and the release cam 9 are arranged to be in phase every rotation and in a released state of the press plate 6 as illustrated in FIG. 11 and FIG. 12, the sheet feed rollers 2 are constructed so that their cut portions (eclipse portions) face the press plate 6 as illustrated in FIG. 12.

The release cam 9 is shaped so as to release the press plate 6 only in the range of the center angle of about 120° of the eclipse portions of the sheet feed rollers 2 and is arranged so that when the portions other than the eclipse portions of the sheet feed rollers 2 face the press plate 6, they are always in contact with the recording sheet P or with the press plate 6 under the pressure of 200 g to 500 g. Further, the release cam 9 releases the press contact of the press plate 6 by pushing down a push-down portion 6*b* of the press plate 6 projecting through a hole bored in the right side plate 5*b* of the base 5, as illustrated in FIG. 6. At this time a cam 6*c* closer to the push-down portion 6*b* of the press plate 6 pushes down a press-plate cam 47 attached to the base 5, illustrated in FIG. 12, whereupon the press-plate cam 47 pivots on a fulcrum 47*a*. The press-plate cam 47 pushes a cam 6*d* down.

As a consequence of the above operation, the press of the press plate 6 is released approximately in parallel without inclination against the base 5 when the push-down portion 6*b* is pushed down at the end of the press plate 6. A clutch spring 48 is set in the clutch gear 8*e* so that the spring tightens in the direction of an arrow B in FIG. 10, so as to prevent the gear from rotating backward.

A separator claw 3 is rotatable about a fulcrum 3*a*, as illustrated in FIG. 10, and is urged under the pressure of 20 g to 100 g against the recording sheet P or against the press plate 6 by a claw spring 10. The separator claw 3 is given for separation upon supply of recording sheets P of so-called plain paper and is provided only on the reference member side, as illustrated in FIG. 6. The separator claw 3 is shaped so as to cover a corner of the recording sheets P in a triangular shape. The recording sheets P can be separated one by one under resistance at the triangular portion o the separator claw 3. This sheets except for the plain paper can be separated one by one by use of resistance at a lower guide portion 5*a* by pushing the recording sheets against the lower guide portion 5*a* (see FIG. 12) of the base 5 while keeping the separator claw 3 away from the recording sheets P.

A release lever 11 and a release cam 12 are provided on the same axis as the release cam 9, as illustrated in FIG. 10. The release lever 11 and release cam 12 are not interlocked with the release cam 9, but are driven independently thereof. They are provided for a user to set the recording sheets P. The release lever 11 and release cam 12 are interlocked with each other through gears, and the release lever 11 has three positions, (1) feed position, (2) thick-sheet set position, and (3) plain-paper set position. The positions are defined at intervals of angles of about 20° to 50° . A ratio of the gears of the release lever 11 and the release cam 12 are set so that the release cam 12 rotates at intervals of about 90° , corresponding to the three positions of the release lever 11.

At (1) the feed position, the release cam 12 pushes down only the push-down portion 6*b* of the press plate 6 and thus it does not act on a push-down portion 3*b* of the separator claw 3. During the normal sheet feed the release lever 11 is located at this position.

At (2) the thick-sheet position, the release cam 12 pushes down only the push-down portion 6*b* of the press plate 6, and thus the separator claw 3 moves down along the press plate 6. Therefore, thick sheets can be set with hooking the separator claw 3 on the recording sheets P.

At (3) the plain-paper set position, the release cam 12 pushes down both the push-down portion 6*b* of the press plate 6 and the push-down portion 3*b* of the separator claw 3, and thus the separator claw 3 is kept up relative to the press plate 6. Therefore, plain paper sheets can be set so as to hook the separator claw 3 at the corner of the recording sheets P.

Each of the gear group (except for the feed-roller shaft), the separator claw 3, release lever 11, and release cam 12, described above is disposed on a shaft placed on the right side plate 5*b* of the base 5 and is mounted so as to be rotatable about the shaft.

Figure 13A:
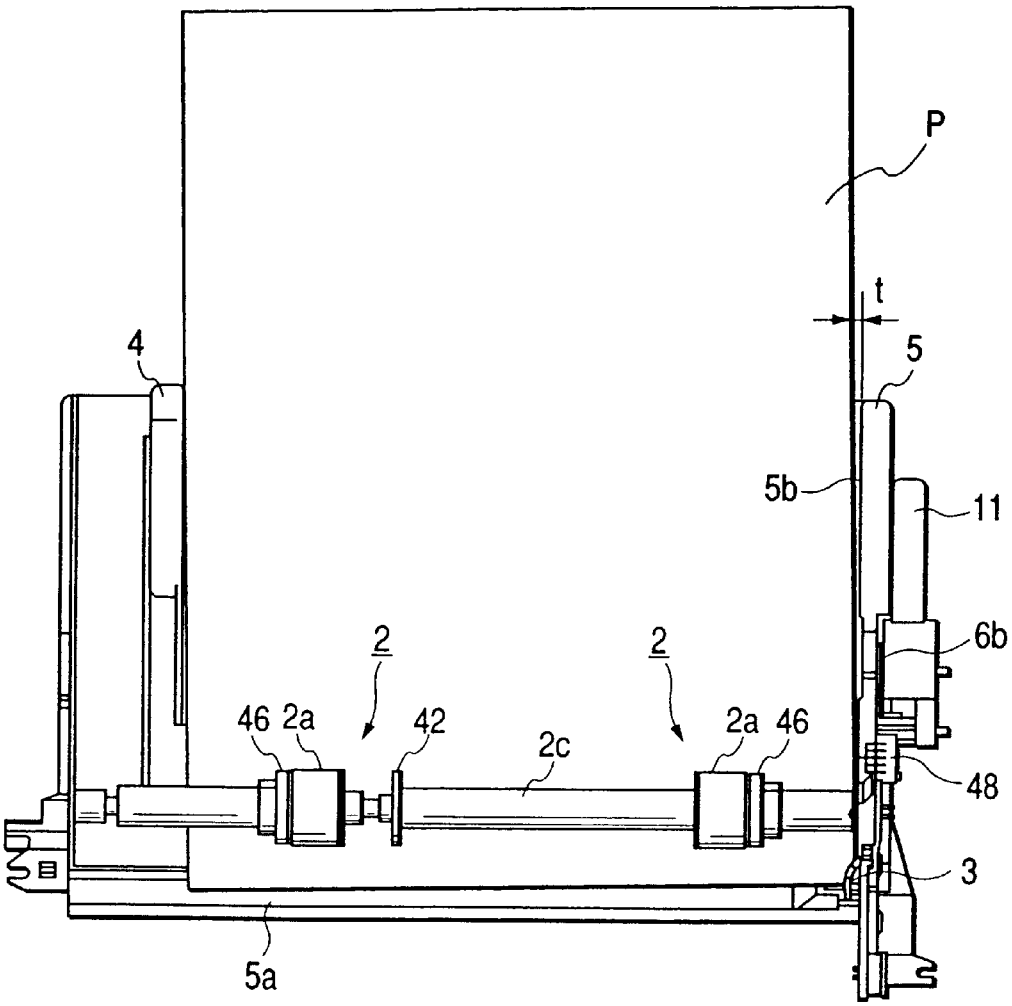
FIGS. 13A and 13B are together an explanatory diagram to show the sheet feed operation.
Figure 13B:
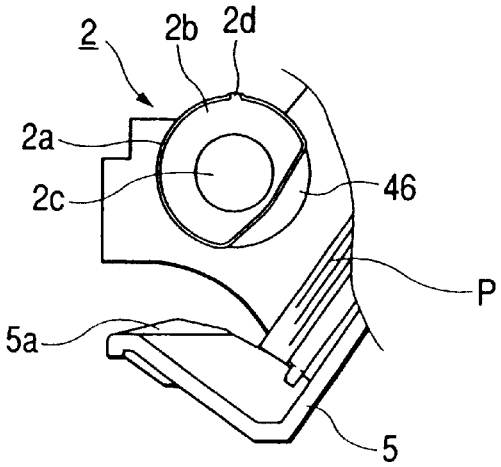

Described next is a process capable of stabilizing the sheet feed state by the effect of the clearance zones of the sheet feed section 1. First, in cases where the separator claw 3 for regulating the leading edges of the recording sheets P is provided only on one side in the sheet feed section 1, as illustrated in FIGS. 13A and 13B, a stack state of the recording sheets P is apt to become such that the sheets are set a little lower on the side without the separator claw 3, with respect to a fulcrum at the separator claw 3. From this state the sheet feed rollers 2 are rotated to start the sheet feed while the recording sheets P supported on the press plate 6 are kept in press contact with the sheet feed rollers 2.

Figure 14A:
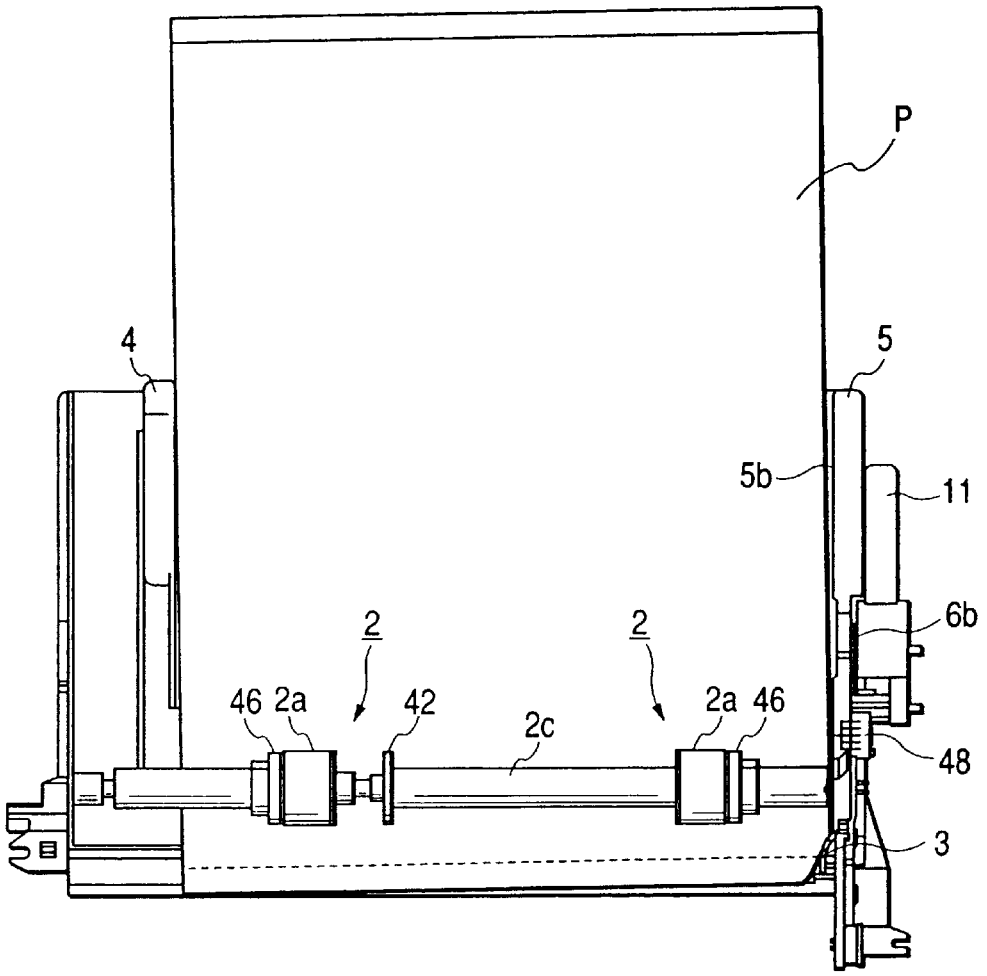
FIGS. 14A and 14B are together an explanatory diagram to show the sheet feed operation.
Figure 14B:
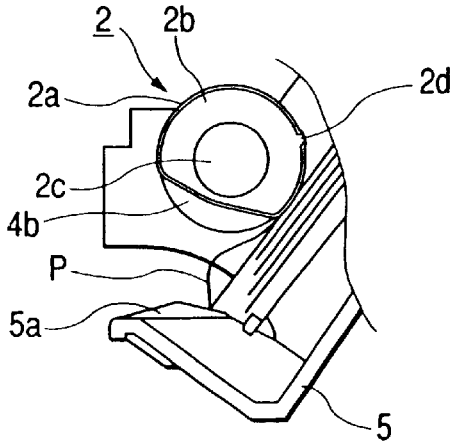
Figure 15A:
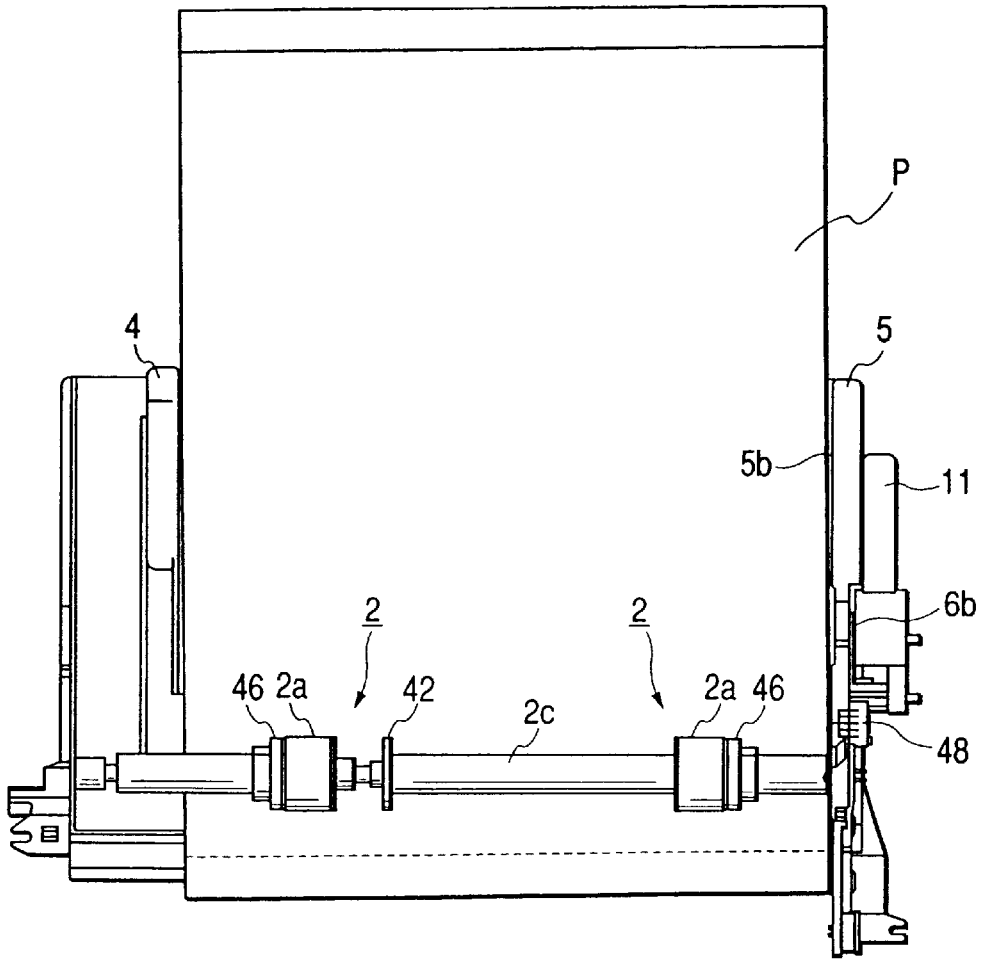
FIGS. 15A and 15B are together an explanatory diagram to show the sheet feed operation.
Figure 15B:
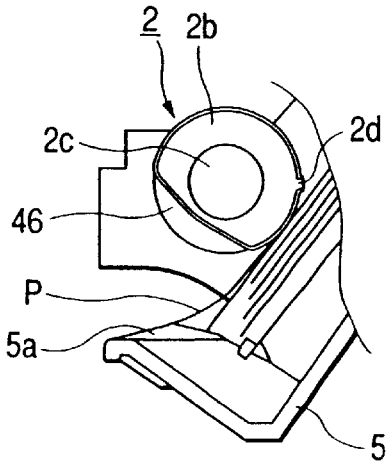

With further rotation of the sheet feed rollers 2, as illustrated in FIGS. 14A and 14B, a recording sheet P starts being separated at the separator claw 3. FIGS. 15A and 15B show a state after completion of separation by the separator claw 3. At this point the recording sheet P still remains inclined, similar to the stack state. After completion of separation by the separator claw 3, the ribs 2*d* of each sheet feed roller 2 come to contact the recording sheet P, while the feed-roller rubber members 2*a* go into a spaced state away from the recording sheet P. Since the above ribs 2*d* are made of the low-friction plastic material and in the integral form with each sheet feed roller 2, the frictional force appearing between the recording sheet P under feed and the recording sheet P stacked on the press plate 6 becomes larger than that appearing between the recording sheet P under feed and the sheet feed rollers 2, so that the recording sheet P under feed is kept at a standstill. In the present embodiment, the ribs 2*d* function both as clearance means and as regulating means for regulating the motion of the recording sheet P.

Figure 16A:
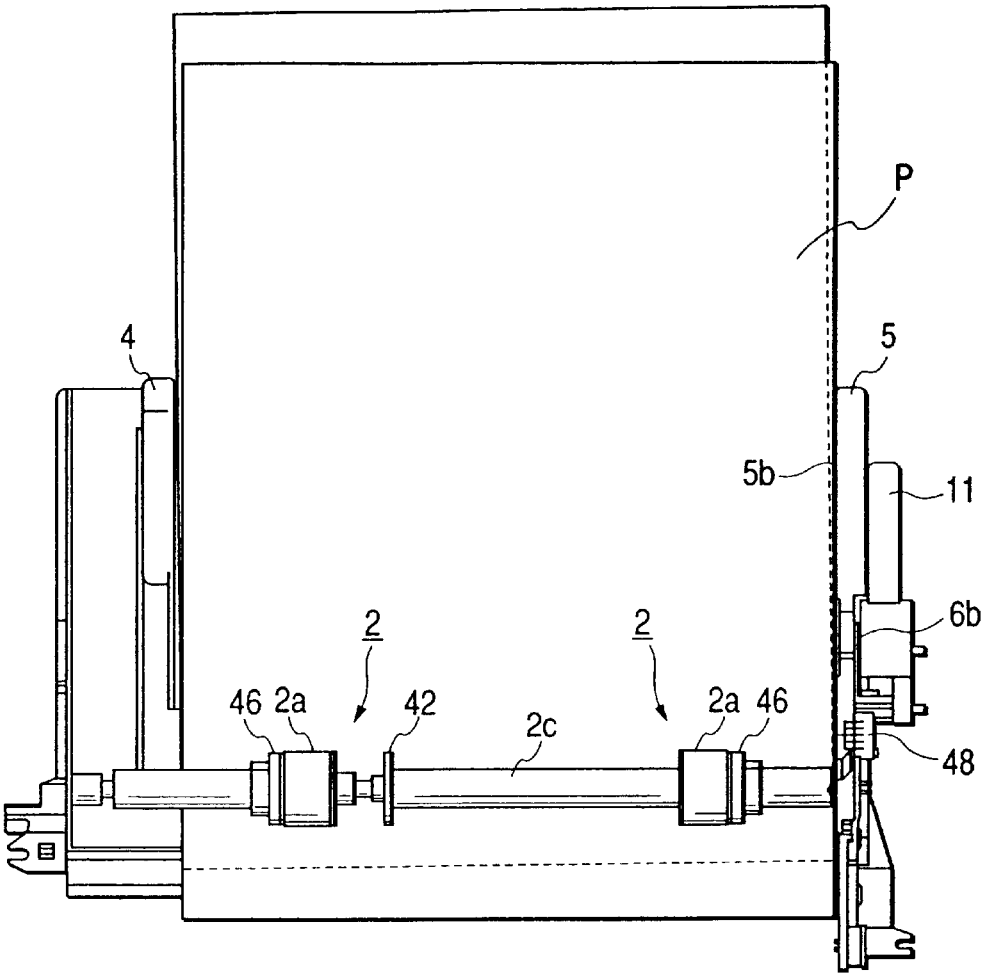
FIGS. 16A and 16B are together an explanatory diagram to show the sheet feed operation.
Figure 16B:
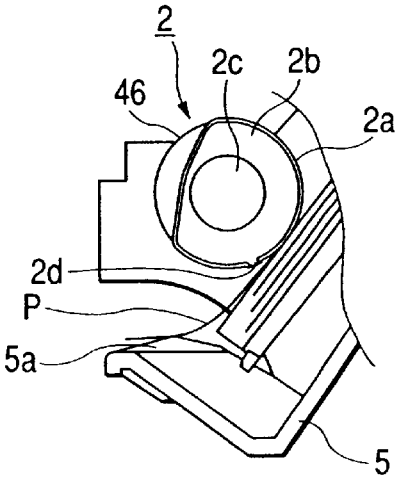

Since the clearance distance between the feed-roller rubber member 2*a* and the recording sheet P is set longer for the other supply roller 2 than the supply roller 2 on the reference member side, the recording sheet P under feed rotates about the roller portion 2*b* on the far side from the reference member, as illustrated in FIGS. 16A and 16B, whereby the reference-member-side edge of the recording sheet P starts butting against the right side plate 5*b* of the base 5 as guide means. When the recording sheet P is inclined counterclockwise before the clearance state between the feed-roller rubber 2*a* and the recording sheet P, the sheet is rotated clockwise by the difference between the widths of the clearance zones of the two roller portions 2*b* as described above. When the reference-member-side edge of the recording sheet P becomes butting against the right side plate 5*b* of the base 5, a counterclockwise rotating force is generated. When this force overcomes the frictional force between the recording sheet P in the stack state and the recording sheet P under feed to bring the two roller portions 2*b* into a slipping state, the recording sheet P is corrected into parallel to the sheet feed direction.

When the recording sheet P is inclined clockwise before the clearance state between the feed-roller rubber members 2*a* and the recording sheet P, the recording sheet is rotated further clockwise by the difference between the widths of the clearance zones of the two roller portions 2*b*. However, when the roller portions 2*b* reach their respective clearance zones to bring the recording sheet P into a slipping state, a force is generated so as to rotate the base-member-side edge of the recording sheet P counterclockwise from the right side plate 5*b* of the base 5. This force overcomes the frictional force between the recording sheet P in the stack state and the recording sheet P under feed, whereby the recording sheet P is corrected to become parallel to the sheet feed direction.

The time when the clearance zones of the roller portion 2*b* leave the recording sheet P is a little earlier on the reference member side than that on the other side, whereby the reference-member-side edge of the recording sheet P is prevented from being separated from the right side plate 5*b* by the counterclockwise rotating force imparted thereon when made to butt against the right side plate 5*b* of the base 5.

A difference between slip amounts of the above roller portions 2*b* was calculated by calculating a clearance t (about 1 mm) due to inclination of the recording sheet P caused by the support only on one side of the recording sheet P by the separator claw 3, as illustrated in FIGS. 13A and 13B, and also calculating a rotation amount of the recording sheet P necessary for canceling t from the distance between the two roller portions 2*b*, and the above setting was made based thereon.

On the other hand, for registration of the sheet P at the sheet's leading edge, the leading edge of the sheet supplied with rotation of the sheet feed rollers 2 of the sheet feed device 1 is brought into contact with the nip between the carriage roller 14 at a standstill and the pinch roller 15, and the sheet P is further fed by the sheet feed rollers 2 to form a loop in the sheet between the sheet feed rollers 2 and the nip. As a consequence, the sheet leading edge is urged against the nip between the carriage roller 14 and the pinch roller 15, whereby oblique feed is corrected thereat (a top registration method).

After that, the carriage roller 14 is rotated to carry the sheet to the recording position (feeding leading end to initial position). Therefore, the sheet P can be fed more accurately to the recording position.

For the registration at the nip between the carriage roller 14 and the pinch roller 15, there are other methods including a method of making the sheet leading edge butt against the nip between the carriage roller pair rotating backward, and a method of once feeding the sheet leading edge to a point downstream of the nip by the carriage roller backward to make the sheet butt against the nip between the carriage roller pair. In either of such methods, since driving of the carriage roller is not continuous in one direction, the top registration requires more time from the sheet feed to carriage to the recording position than the side registration method.

The control operation of Embodiment 1 will be described below referring to FIG. 3.

In FIG. 3, when the recording apparatus receives printing data in step S1, it determines in step S2 whether the received data is document data. When it is document data, the top margin is oriented up to the recording area of the sheet P by only the side registration method in step S3.

Specifically, the sheet feed roller 2 are rotated to feed the sheet while urging the reference-member-side side edge of the sheet P against the sheet reference surface 5*b* by the action of the ribs 2*d* of the sheet feed rollers 2 as described above.

The leading end of the sheet is pinched between the carriage roller 14 under counterclockwise rotation and the pinch roller 15 and is further conveyed in that state to the downstream and stopped at the recording position.

When in step S2 the received data is data other than the document data, i.e., high-quality image data such as a photo-like image, the top margin of the sheet P is oriented by the combination of the side registration with the top registration in step S4.

Specifically, correction for oblique feed is effected by urging the side edge of the sheet P against the sheet reference surface 5*b* by the sheet feed rollers 2, similar to step S3, and a loop is formed by making the leading edge of the sheet P further fed, butt against the nip between the carriage roller 14 at a standstill and the pinch roller 15, thereby correcting for oblique feed of the sheet edge.

After that, the carriage roller 14 is rotated to feed the leading end to the initial position (orient the top margin).

Further, the apparatus moves into step S5 to start printing and the printing is completed by the sheet discharge operation in step S6.

The above operation adopts the registration methods of the sheet P suitable for printing contents and thus permits the throughput to be increased in the document case while permitting printing to be performed with high accuracy in the other cases.

Embodiment 2

In Embodiment 1 the apparatus was constructed to be able to select either of the registration methods according to the recording modes, whereas in Embodiment 2 the apparatus is constructed to be able to select either of the registration methods according to recording media. The structure of the recording apparatus is similar to that in Embodiment 1.

The control operation of this Embodiment 2 will be described referring to FIG. 4.

In FIG. 4, the recording apparatus receives the printing data in step S1, as in Embodiment 1. The leader part of this data contains data to give identification of a kind of the recording medium according to the quality of image. For example, high-quality image data contains data to select a high-quality-dedicated sheet.

In step S2 whether the recording medium is plain paper is determined from the received data. When the recording medium is plain paper, the top margin is oriented up to the recording area of the sheet P by the side registration method in step S3. If it is not, the top margin of the sheet P is oriented by the combination of the side registration with the top registration in step S4. After that, the apparatus moves into step S5 to start printing and the printing is completed by the sheet discharge operation of step S6.

Since the present embodiment employs the registration methods of sheet P suitable for the recording media according to the above operation, it permits the throughput to be increased in the case of plain paper, while permitting printing to be carried out with high accuracy in the other cases (postcard, glossy paper, glossy film, high-quality dedicated paper (coat paper), etc.).

Embodiment 3

Embodiment 3 of the recording apparatus according to the present invention will be described with reference to FIG. 5. Since the structure of the recording apparatus is similar to that in Embodiment 1, the description thereof is omitted herein.

In step S1, whether the recording head 24 mounted on the carriage 26 on the recording apparatus is the normal head or the photo head for photo-like recording is determined by ID given to the recording head. When the recording head is the photo head, with reception of printing data in step S2, the registration operation is carried out by the side registration and the top registration in step S4. When the recording head 24 is not the photo head, with reception of printing data in step S3, the registration operation is carried out by the side registration in step S5. After that, printing is started in step S6 and the printing is completed by the sheet discharge operation of step S7.

Since the present embodiment adopts the registration methods of sheet P according to the recording heads by the above operation, it permits the throughput to be increased in the case of the normal head, while permitting the printing to be carried out with high accuracy in the case of the photo head.

Embodiment 4

In each of the above embodiments, because the ribs 2*d* of the different lengths are formed in the left and right sheet feed rollers 2 of the sheet feed device 1, the side registration is always effected in cooperation with the right side plate 5*b* (reference surface).

It is, however, noted that the present invention can also be applied to the recording apparatus having the ordinary sheet feed rollers intended not to effect the side registration.

In this case, the top registration is effected in the recording of the high-quality image data such as the photo-like image or the like, and the correction for skew feeding is not carried out in the recording of the document data.

The operation of Embodiment 4 of such apparatus will be described referring to FIG. 17.

The structure of the recording apparatus of Embodiment 4 is substantially the same as that in FIG. 2 except that the ribs 2*d* are not formed in the sheet feed rollers, and thus reference is also made to FIG. 2.

Figure 17:
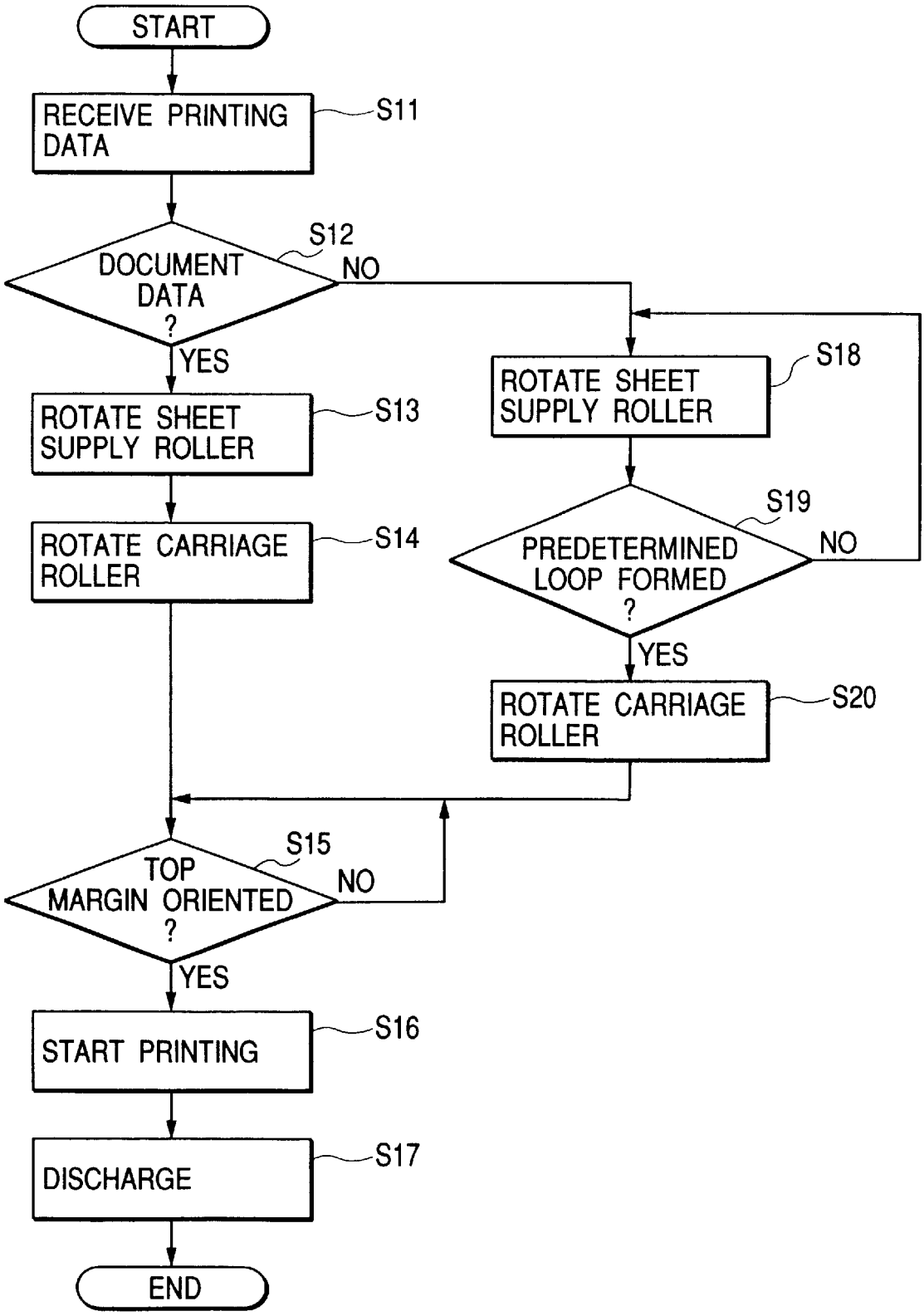
FIG. 17 is a flowchart to show the operation of the fourth embodiment of the present invention.

In FIG. 17, printing data sent from a computer or the like is received in step S11 and whether the data is high-quality image data is determined in step S12.

In the case of the document data, the sheet feed rollers 2 are rotated to feed the sheet P (step S13). Almost at the same time as the sheet feed or after a lapse of a predetermined time, the carriage roller 14 is also actuated to rotate (step S14) to convey the fed sheet P immediately to between the platen 22 and the recording head 24 to feed the leading end to the initial position.

When it is determined in step S15 that the top margin is oriented, printing is started (step S16) and the sheet discharge operation is carried out (step S17).

When it is determined in step S12 that the received data is high-quality image data, the sheet P is fed by the sheet feed rollers 2 in step S18. Then the leading edge of the sheet is made to butt against the nip between the carriage roller 14 at a standstill and the pinch roller 15. When a predetermined loop is judged as being formed in the sheet (step S19), based on an elapsed time or the like from the start of the driving of the sheet feed rollers 12, the carriage roller 14 is driven (step S20) to effect orientation of the top margin (step S15). Then the recording operation is carried out and the sheet is discharged (steps S17, S18).

As described above, according to the present invention, the registration to align the side of the recording medium with the reference surface is selected in the high-speed mode or the normal mode used in recording of documents etc., while the registration to align the leading edge of the recording medium with the nip between the carriage roller pair is selected in the high-quality mode used in recording of photo-like images etc. other than the documents; therefore, the invention presents the remarkable effects of permitting the considerable increase of the throughput in the case of the document recording and permitting good recording without disturbance of the image in the case of the high-quality recording of photo-like images etc. other than the documents.

Since the apparatus is constructed to select either of the registration methods, not only depending upon the recording modes, but also depending upon the recording media, good recording, similar to the above, can also be achieved by selecting the registration at the leading edge of the recording medium in the case of special media such as postcards or the like. In addition, because the apparatus is constructed similarly to select either of the registration methods, depending upon types of the recording heads, the invention always presents the effects of permitting good recording with the recording head for high quality and permitting high-speed continuous recording with the recording head used for documents or the like.

What is claimed is:

1. A recording apparatus capable of performing a plurality of recording modes, said recording apparatus comprising:

an automatic feed device for feeding recording media one by one;

a pair of conveying rollers for conveying a recording medium, thus fed, to a recording section; and a registration unit for registering the recording medium, wherein said registration unit includes a plurality of registration modes and a mode for registration of said recording medium to the recording section is selected according to said recording mode.

2. The recording apparatus according to claim 1, wherein a mode of registration to align a leading edge of said recording medium with a nip between the conveying roller pair is selected when said recording mode is a high-quality mode.

3. The apparatus according to claim 2, wherein said recording modes include a mode for carrying out recording of a photo-like image in the high-quality mode.

4. A recording apparatus capable of performing a plurality of recording modes for recording an image on a sheet with a recording head, said apparatus comprising:

a pair of conveying rollers disposed on an upstream side of the recording head in a conveying direction of a sheet;

sheet feed means for feeding a sheet to said conveying roller pair; and performing means for performing correction control in one of an oblique feed correction mode in which a sheet fed by said sheet feed means is subjected to correction for oblique feed by making a leading edge thereof engage a nip between said conveying roller pair and thereafter controlling said conveying roller pair so as to convey the sheet toward said recording head, and a carry correction mode in which said conveying roller pair is controlled so as to convey the sheet fed by said sheet feed means toward said recording head without correction for oblique feed;

wherein said performing means selects one of the control modes according to a recording mode.

5. The recording apparatus according to claim 4, wherein said recording head performs recording in a plurality of recording modes, said recording modes differing in at least one of pixel density, ink type and ink variety.

6. The recording apparatus according to claim 4, wherein said recording head operates in one of a standard recording mode and a high-quality recording mode, a pixel density of which is higher than that of the standard recording mode, and wherein said performing means controls said conveying roller pair in the carry correction mode when said recording mode is the standard recording mode and in the oblique feed correction mode when the recording mode is the high-quality recording mode.

7. The recording apparatus according to claim 4, wherein said recording head operates in one of a standard recording mode and a high-quality recording mode the number of different kinds of ink of which is greater than that of the standard recording mode and wherein said performing means controls said conveying roller pair in the carry correction mode when said recording mode is the standard recording mode and in the oblique feed correction mode when the recording mode is the high-quality recording mode.

8. The recording apparatus according to claim 4, wherein in said oblique feed correction mode, oblique feed is corrected by engaging a leading edge of a sheet fed by said sheet feed means in a nip between said conveying roller pair at a standstill to form a loop in the sheet between said nip and said sheet feed means.

9. The recording apparatus according to claim 4, wherein in said oblique feed correction mode, oblique feed is corrected by making a leading edge of a sheet fed by said sheet feed means engage a nip between said conveying roller pair under rotation in a direction opposite to the conveyance direction.

10. The recording apparatus according to claim 4, wherein in said oblique feed correction mode, oblique feed is corrected by pinching a leading edge of a sheet fed by said sheet feed means by a nip between said conveying roller pair under rotation in the conveyance direction and thereafter rotating said conveying roller pair backward to make the leading edge of the sheet engage the nip.

11. The recording apparatus according to claim 4, comprising position regulating means for regulating a position of a side edge of a sheet, wherein said sheet feed means urges the side edge of the sheet against said position regulating means.

12. A recording apparatus capable of performing a plurality of recording modes for recording an image on a recording medium with a recording head, said apparatus comprising:

a feed mechanism for feeding the recording medium to a position where said recording head records on the recording medium; and a drive control portion for driving said feed mechanism by selecting, in accordance with selection of one of a plurality of recording modes, a first conveyance mode for performing an oblique correction to a recording medium conveyance direction and a second conveyance mode not for performing the oblique correction when the recording medium is conveyed to the recording position.

13. The recording apparatus according to claim 12, wherein said recording head performs recording in a plurality of recording modes, said recording modes differing in at least one of pixel density, ink type and ink variety.

14. The recording apparatus according to claim 12, wherein said recording head operates in one of a standard recording mode and a high-quality recording mode, a pixel density of which is higher than that of the standard recording mode, and wherein said drive control portion controls said feed mechanism in the second conveyance mode when said recording mode is the standard recording mode and in the oblique feed correction mode when the recording mode is the high-quality recording mode.

15. The recording apparatus according to claim 12, wherein said recording head operates in one of a standard recording mode and a high-quality recording mode the number of different kinds of ink of which is greater than that of the standard recording mode and wherein said drive control portion controls said feed mechanism in the second conveyance mode when said recording mode is the standard recording mode and in the oblique feed correction mode when the recording mode is the high-quality recording mode.

16. The recording apparatus according to claim 12, wherein in said oblique feed correction mode, oblique feed is corrected by engaging a leading edge of a sheet fed by said feed mechanism in a nip between a conveying roller pair at a standstill to form a loop in the sheet.

17. The recording apparatus according to claim 12, wherein in said oblique feed correction mode, oblique feed is corrected by making a leading edge of a sheet fed by said feed mechanism engage a nip between a conveying roller pair under rotation in a direction opposite to the conveyance direction.

18. The recording apparatus according to claim 12, wherein in said oblique feed correction mode, oblique feed is corrected by pinching a leading edge of a sheet fed by said feed mechanism by a nip between a conveying roller pair under rotation in the conveyance direction and thereafter rotating the conveying roller pair backward to make the leading edge of the sheet engage the nip.

19. The recording apparatus according to claim 12, further comprising position regulating means for regulating a position of a side edge of a sheet, wherein said feed mechanism urges the side edge of the sheet against said position regulating means.

20. A method of recording in one of a plurality of recording modes, each for recording an image on a sheet with a recording head, said method comprising the steps of:

feeding a sheet to a conveying roller pair disposed upstream of the recording head; and performing correction control in one of an oblique feed correction mode in which the fed sheet is subjected to correction for oblique feed by making a leading edge thereof engage a nip between the conveying roller pair so as to convey the sheet toward the recording head, and a carry correction mode in which the conveying roller pair is controlled so as to convey the fed sheet toward the recording head without correction for oblique feed, wherein the control mode is selected according to the recording mode.

21. A method of recording in one of a plurality of recording modes, each for recording an image on a recording medium with a recording head, said method comprising the steps of:

feeding the recording medium to a position where the recording head records on the recording medium; and driving a feed mechanism by selecting, in accordance with a selection of one of a plurality of recording modes, a first conveyance mode for performing an oblique correction to a recording medium conveyed to the recording position and a second conveyance mode not for performing the oblique correction when the recording medium is conveyed to the recording position.

* * * * *

UNITED STATES PATENT AND TRADEMARK OFFICE

CERTIFICATE OF CORRECTION

PATENT NO. : 6,341,905 B1
DATED : January 29, 2002
INVENTOR(S) : Tetsuo Suzuki

It is certified that error appears in the above-identified patent and that said Letters Patent is hereby corrected as shown below:

Title page,
Item [57], ABSTRACT,
Line 6, "of" should read -- of registering --.
Line 12, "in increase of" should read -- to increase the --.

Column 7,
Line 2, "o" should read -- of --.
Line 3, "This" should read -- Thick --.
Line 18, "are" should read -- is --.

Column 9,
Line 44, "sheet P" should read -- sheet P, --.

Column 12,
Lines 30 and 39, "in" should read -- to be in --.

Column 13,
Lines 24 and 32, "in" should read -- to be in --.

Column 14,
Line 19, "in" should read -- to be in --.

Signed and Sealed this

Seventh Day of May 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,341,905 B1
DATED : January 29, 2002
INVENTOR(S) : Tetsuo Suzuki

It is certified that error appears in the above-identified patent and that said Letters Patent is hereby corrected as shown below:

Column 13,
Line 10, “modes, a first” should read -- modes, one of a first --.

Column 14,
Line 40, “modes, a first” should read -- modes, one of a first --.

Signed and Sealed this

Fourth Day of February, 2003

JAMES E. ROGAN
*Director of the United States Patent and Trademark Office*